United States Patent [19]

Furutachi

[11] Patent Number: 4,588,679

[45] Date of Patent: May 13, 1986

[54] COLOR PHOTOGRAPHIC SILVER HALIDE LIGHT-SENSITIVE MATERIAL

[75] Inventor: Nobuo Furutachi, Kanagawa, Japan

[73] Assignee: Fuji Photo Film Co., Ltd., Kanagawa, Japan

[21] Appl. No.: 569,136

[22] Filed: Jan. 9, 1984

[30] Foreign Application Priority Data

Jan. 7, 1983 [JP] Japan ..... 58-937

[51] Int. Cl.[4] ..... G03C 7/26

[52] U.S. Cl. ..... 430/551; 430/558

[58] Field of Search ..... 430/551, 558

[56] References Cited

U.S. PATENT DOCUMENTS

| | | | |
|---|---|---|---|
| 3,725,067 | 4/1973 | Bailey et al. | 430/558 |
| 4,174,220 | 11/1979 | Taguchi et al. | 430/551 |
| 4,277,553 | 7/1981 | Onodera et al. | 430/551 |
| 4,401,752 | 8/1983 | Lau | 430/558 |
| 4,443,536 | 4/1984 | Lestina | 430/558 |

FOREIGN PATENT DOCUMENTS

| | | | |
|---|---|---|---|
| 1247493 | 9/1971 | United Kingdom | 430/558 |

*Primary Examiner*—J. Travis Brown

*Attorney, Agent, or Firm*—Sughrue, Mion, Zinn Macpeak & Seas

[57] ABSTRACT

A color photographic silver halide light-sensitive material is described. The material contains a 1H-pyrazolo[3,2-C]-s-triazole type coupler and, as a color image stabilizer, a compound represented by the formula (I):

(I)

(wherein all the symbols are as defined in the appended claims). Addition of the color image stabilizer of the formula (I) improves the light fastness of magenta color images formed from the 1H-pyrazolo[3,2-C]-s-triazole type coupler. Thus the light-sensitive material of the invention exhibits high photographic performance.

6 Claims, No Drawings

COLOR PHOTOGRAPHIC SILVER HALIDE LIGHT-SENSITIVE MATERIAL

FIELD OF THE INVENTION

The present invention relates to a color photographic silver halide light-sensitive material and, more particularly, to a color photographic silver halide light-sensitive material containing a 1H-pyrazolo[3,2-C]-s-triazole type magenta coupler and a phenol or phenol ether-based compound.

BACKGROUND OF THE INVENTION

It is well known that when an exposed color photographic silver halide light-sensitive material is color-developed, an oxidized aromatic primary amine-based developing agent reacts with a coupler to form a dye such as indophenol, indoaniline, indamine, azomethine, phenoxazine and phenazine, resulting in the formation of dye image. In the formation of magenta color images, 5-pyrazolone, cyanoacetophenone, indazolone, pyrazolobenzimidazole and pyrazolotriazole-based couplers are used.

Most of the compounds which have heretofore been in wide-spread use and extensively studies as magenta color image-forming couplers are 5-pyrazolones. It is known, however, that although dyes formed from 5-pyrazolone-based couplers exhibit high fastness against heat and light, they show an unnecessary absorption having a yellow component in the neighborhood of 430 nm, causing color-mixing.

Magenta color image-forming coupler skeletons which have been proposed to reduce the yellow component include a pyrazolobenzimidazole skeleton as described in British Pat. No. 1,047,612, an indazolone skeleton as described in U.S. Pat. No. 3,770,447, and a pyrazolotriazole skeleton as described in U.S. Pat. No. 3,725,067.

Dyes formed from 1H-pyrazolo[3,2-C]-s-triazole type magenta couplers as described in U.S. Pat. No. 3,725,067, British Pat. Nos. 1,252,418 and 1,334,515 show a reduced unnecessary absorption in the neighborhood of 430 nm in solvents such as ethyl acetate and dibutyl phthalate, and, furthermore, are superior in sharp cut-properties at the long wavelength side.

However, azomethine dyes formed from 1H-pyrazolo[3,2-C]-s-triazole type couplers show seriously low fastness against light, deteriorating seriously the performance of color light-sensitive material, particularly print-based color light-sensitive material.

SUMMARY OF THE INVENTION

As a result of extensive investigations, it has been found that a series of compounds greatly increases the light-fastness of color images.

An object of the invention is to provide a color photographic silver halide light-sensitive material in which the light fastness of magenta color images formed from 1H-pyrazolo[3,2-C]-s-triazole type couplers is improved.

The present invention relates to a color photographic silver halide light-sensitive material characterized by containing a 1H-pyrazolo[3,2-C]-s-triazole type coupler and a compound represented by the formula (I):

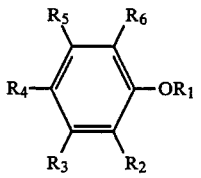

(I)

wherein $R_1$ is a hydrogen atom, an alkyl group, an aryl group, a silyl group or a heterocyclic group; $R_2$, $R_3$, $R_5$ and $R_6$ are each a hydrogen atom, a hydroxyl group, an alkyl group, an aryl group, an alkoxyl group or an acylamino group; $R_4$ is an alkyl group, a hydroxyl group, an aryl group, a silyloxy group, or an alkoxyl group; $R_1$ and $R_2$ may combine together to form a 5- or 6-membered ring, provided that $R_4$ is a hydroxyl group or an alkoxyl group, or $R_1$ and $R_2$ may combine together to form a methylenedioxy ring; and $R_3$ and $R_4$ may combine together to form a 5-membered hydrocarbon ring, provided that $R_1$ is an alkyl group, an aryl group or a heterocyclic ring.

DETAILED DESCRIPTION OF THE INVENTION

The 1H-pyrazolo[3,2-C]-s-triazole type coupler as used herein includes the compounds described in U.S. Pat. No. 3,725,067 (incorporated herein by reference to disclose such a coupler) and is represented by the formula (II):

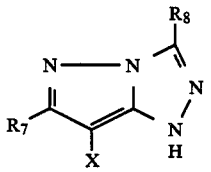

(II)

wherein $R_7$ and $R_8$ are each a hydrogen atom, an alkyl group, an alkylthio group, an aryl group, a heterocyclic ring consisting of from 5 to 6 atoms, an amino group, an acylamino group, a hydroxyl group, an alkoxy group, an alkoxycarbonyl group, an aryloxycarbonyl group, a carbamoyl group, a sulfamoyl group or a sulfonamide group; and X is a hydrogen atom, a halogen atom, an alkoxyl group, an aryloxy group, an acyloxy group, a 5- or 6-membered heterocyclic oxy group, an alkylthio group, an arylthio group, a 5- or 6-membered heterocyclic ring thio group, or a group

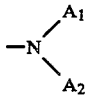

(wherein $A_1$ and $A_2$ are each a hydrogen atom, an alkyl group, an aryl group, a heterocyclic ring group, an acyl group, a sulfonyl group, a carbamoyl group, a sulfamoyl group, or an alkoxy-carbonyl group, provided that $A_1$ and $A_2$ are not hydrogen atoms at the same time; and $A_1$ and $A_2$ may combine together to form a 5- or 6-membered ($6\pi$ or $10\pi$ electron system-constituting) aromatic heterocyclic group containing a nitrogen atom linked to a 5- or 6-membered ring formed in combination with a nitrogen atom, a non-aromatic saturated or unsaturated nitrogen-containing heterocyclic ring group, a cyclic imide group, a 2-N-1,1-dioxo-3-(2H)- oxo-1,2-benzisothiazolyl group (saccharin), or a saturated or unsaturated cyclic lactam ring group). In the formula (II) above, when the $R_7$, $R_8$ and/or X represents a substituent containing an alkyl moiety or an aryl moiety, the alkyl moiety can contain 1 to 45 carbon atoms and the aryl moiety can contain 6 to 45 carbon atoms.

The color image stabilizer as used herein is represented by the formula (I):

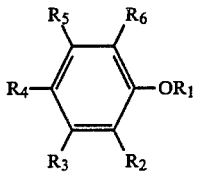

(I)

wherein $R_1$ is a hydrogen atom, an alkyl group, an aryl group, a silyl group, or a heterocyclic group; $R_2$, $R_3$, $R_5$ and $R_6$ are each a hydrogen atom, a hydroxyl group, an alkyl group, an aryl group, an alkoxyl group or an acylamino group; $R_4$ is an alkyl group, a hydroxyl group, an aryl group, a silyloxy group or an alkoxyl group; $R_1$ and $R_2$ may combine together to form a 5- or 6-membered ring, provided that $R_4$ is a hydroxyl group or an alkoxyl group, or $R_1$ and $R_2$ may combine together to form a methylenedioxy ring; and $R_3$ and $R_4$ may combine together to form a 5-membered hydrocarbon ring, provided that $R_1$ is an alkyl group, an aryl group or a heterocyclic group. In the formula (I) above, when the $R_1$, $R_2$, $R_3$, $R_4$, $R_5$ and/or $R_6$ represent a substituent containing an alkyl moiety or an aryl moiety, the alkyl moiety can contain 1 to 45 carbon atoms and the aryl moiety can contain 6 to 45 carbon atoms.

Examples of the color image stabilizer represented by the general formula (I) include the compounds described in U.S. Pat. Nos. 3,935,016, 3,982,944, 4,254,216, British Patent Laid-Open Nos. 2,077,455A, 2,062,888A, U.S. Pat. Nos. 3,764,337, 3,432,300, 3,574,627, 3,573,050, 4,113,495, 4,159,910, 4,155,765, British Pat. No. 1,347,556, British Patent Laid-Open No. 2,066,975A and U.S. Pat. No. 3,700,455.

Typical examples of magenta couplers which can be used are shown below although the present invention is not limited thereto.

C-1

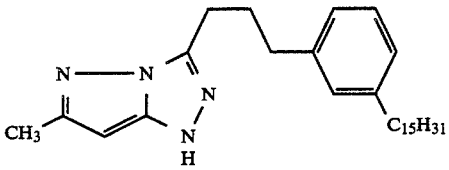

C-2

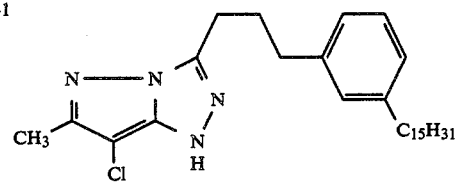

C-3

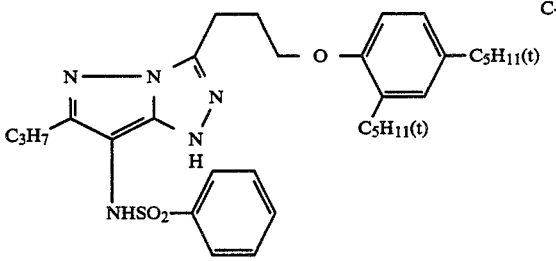

C-4

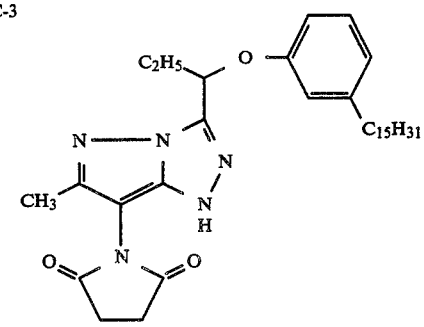

C-5

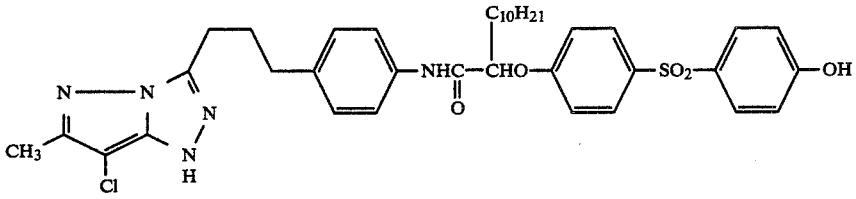

C-6

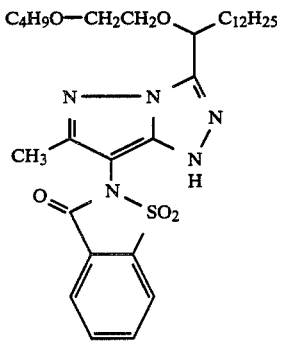

C-7

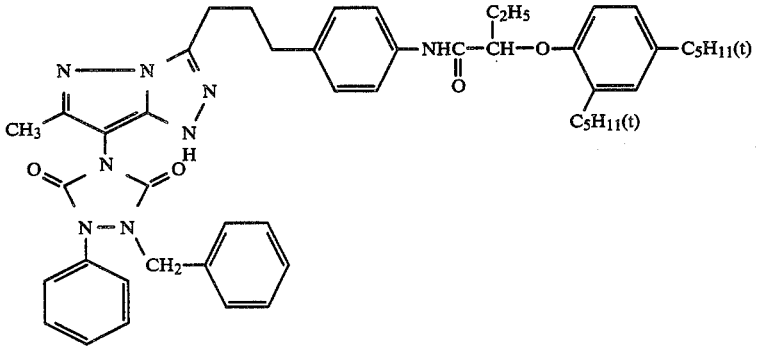

-continued
C-8
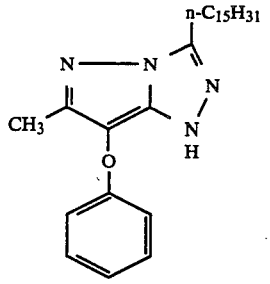
C-9
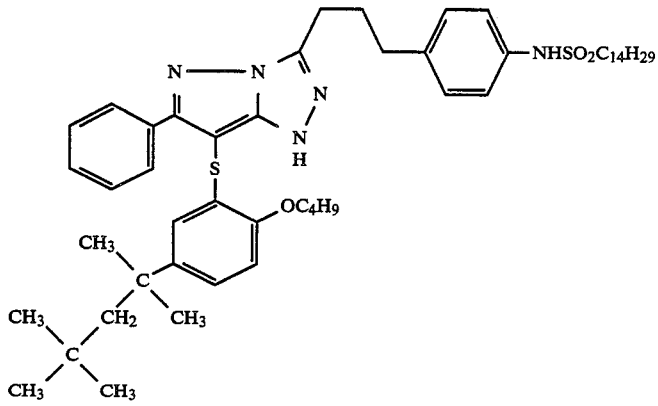
C-10
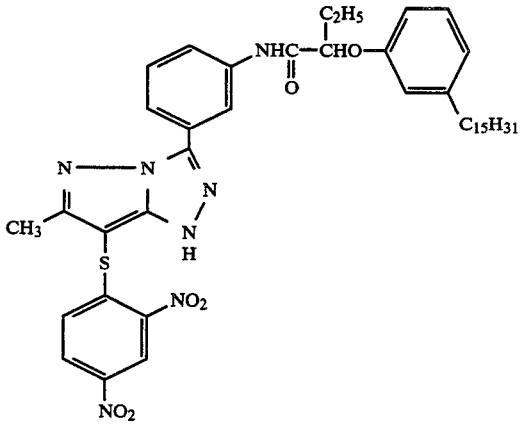
C-11
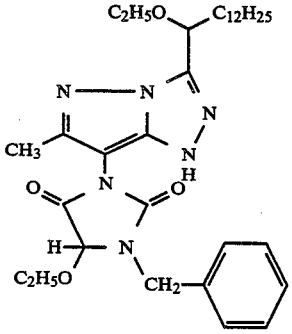
C-12
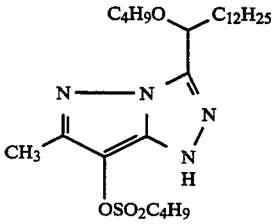
C-13
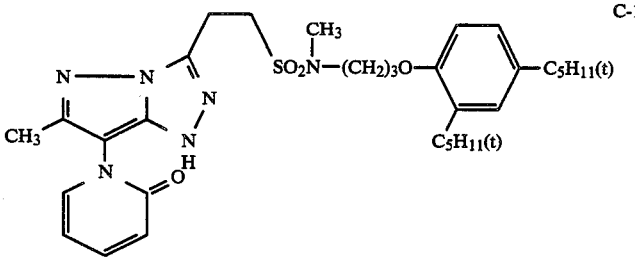
C-14
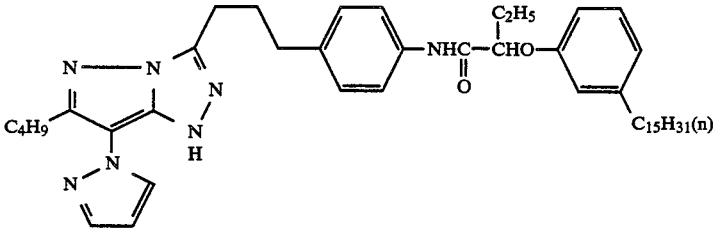
C-15
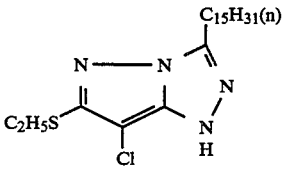
C-16
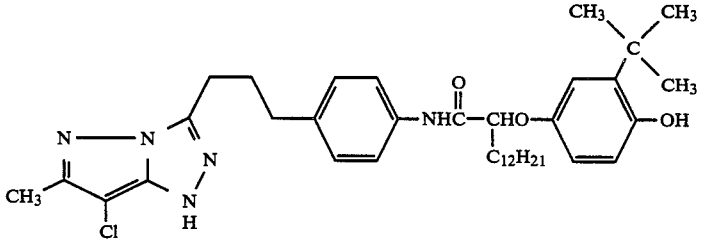

-continued
C-17
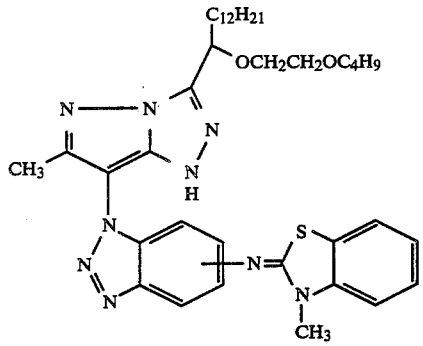
C-18
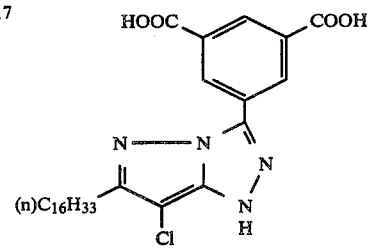
C-19
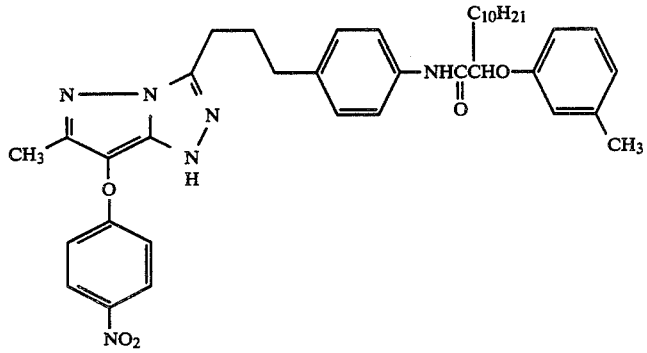
C-20
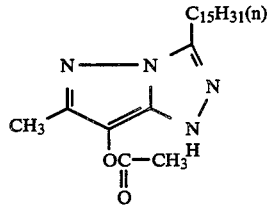
C-21
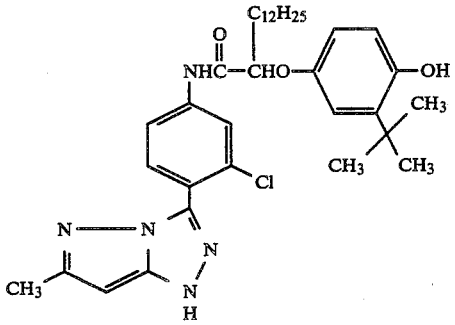
C-22
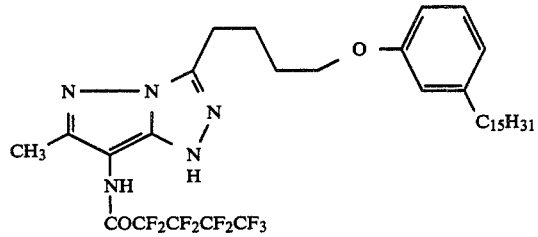
C-23
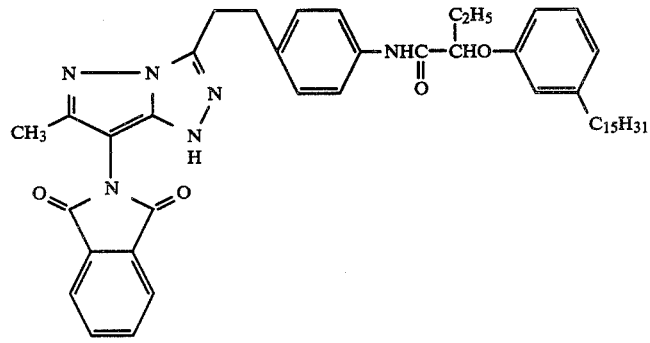

-continued
C-24
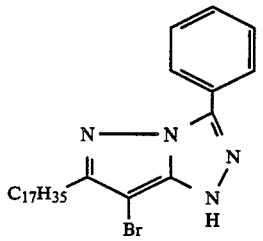
C-25
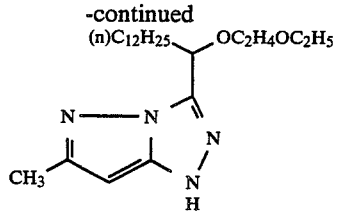
C-26
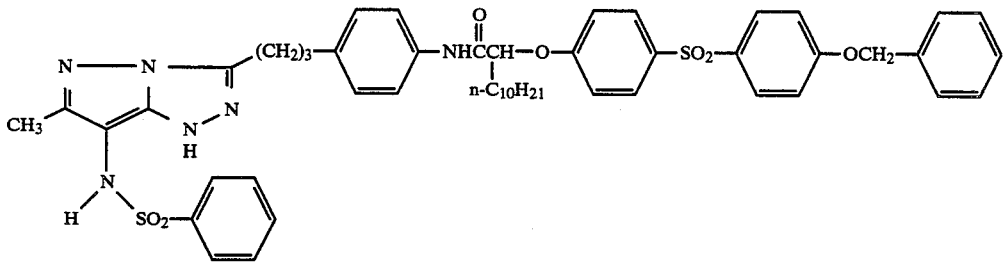
C-27
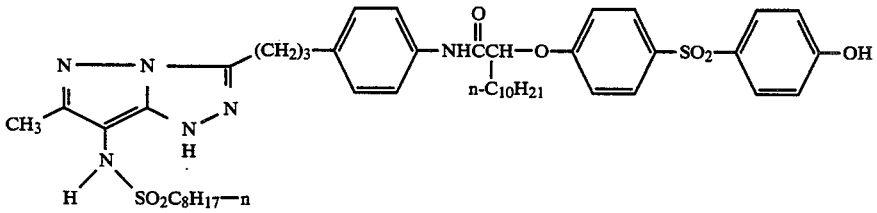
C-28
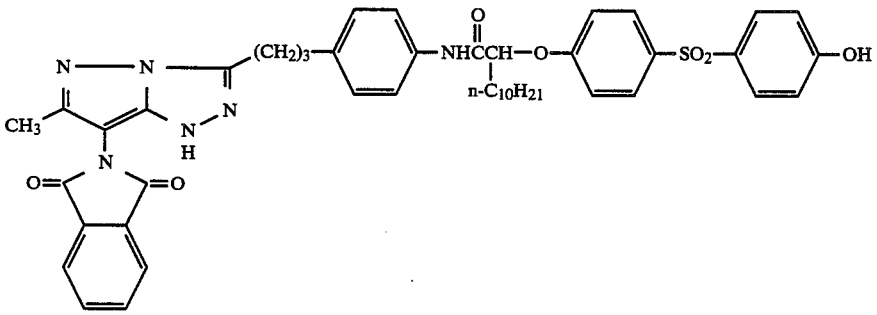
C-29
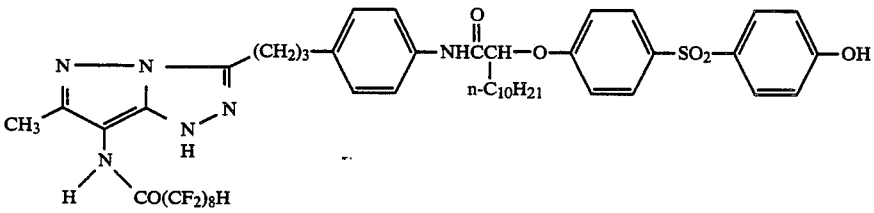
Typical examples of phenol or phenol ether-based compounds which are used as color image stabilizers in the present invention are shown below although the present invention is not limited thereto.
A-1
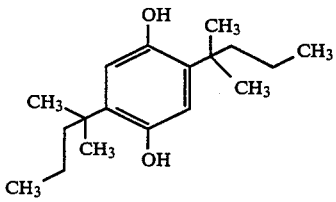
-continued
A-2
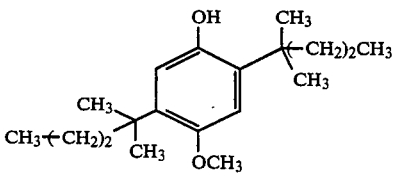

-continued
A-3
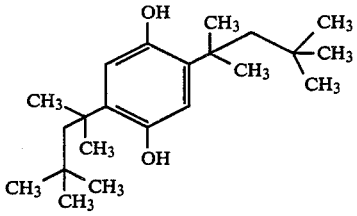
A-4
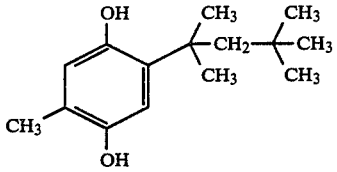
A-5
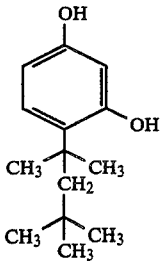
A-6
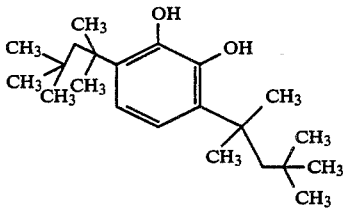
A-7
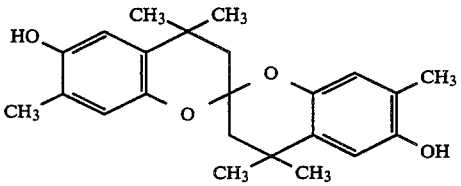
A-8
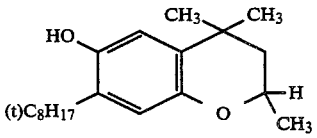
A-9
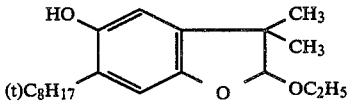
A-10
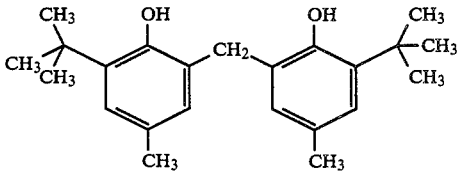
-continued
A-11
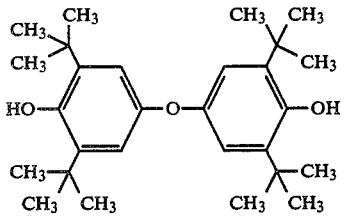
A-12
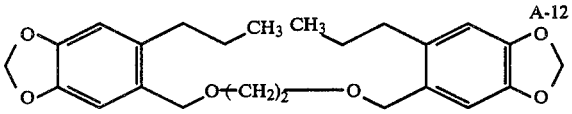
A-13
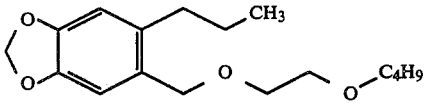
A-14
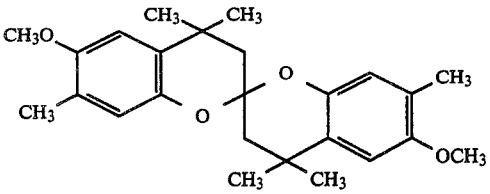
A-15
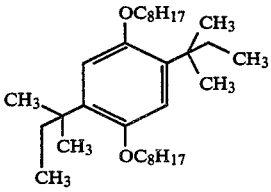
A-16
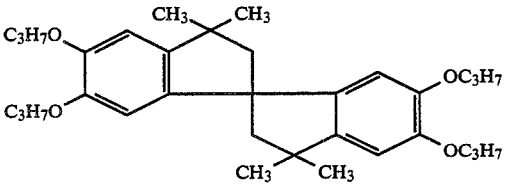
A-17
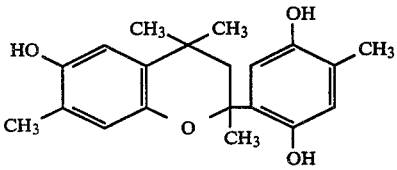
A-18
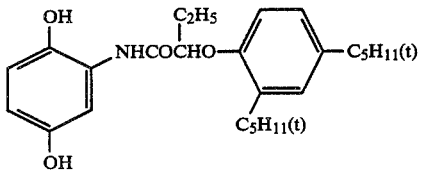
A-19
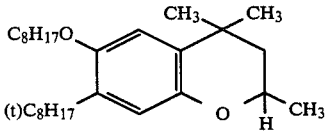

-continued

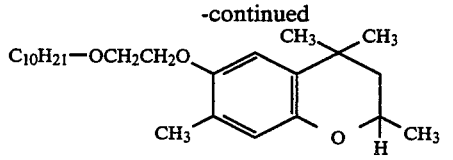

A-20

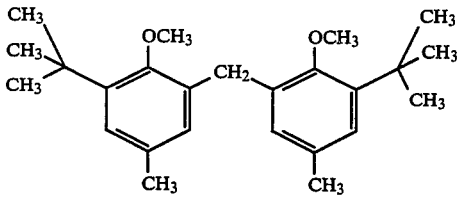

A-21

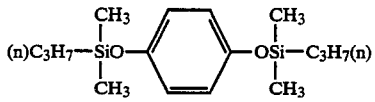

A-22

In addition to the couplers of the invention as described above, dye-forming couplers, i.e., compounds capable of forming color through oxidative coupling with aromatic primary amine developers (such as phenylene-diamine derivatives and aminophenol derivatives) in color development can be used in the present invention. For example, a 5-pyrazolone coupler, a pyrazolobenzimidazole coupler, a cyanoacetylcumarone coupler, an open chain acylacetonitrile coupler, etc., can be used as magenta couplers; an acylacetamide coupler (e.g., benzoylacetanilides and pivaloylacetanilides), etc., can be used as yellow couplers; and a naphthol coupler and a phenol coupler can be used as cyan couplers.

These couplers are preferred to be non-diffusing ones having a hydrophobic group called a ballast group in the molecule thereof, or to be polymerized ones. They may be either 4-equivalent or 2-equivalent relative to silver ions. Further, they may be colored couplers having the effect of color correction, or so-called DIR couplers releasing a development inhibitor during development.

In addition to the DIR couplers, colorless DIR coupling compounds yielding a colorless coupling reaction product and releasing a development inhibitor may be incorporated.

Two or more of the couplers as described above may be incorporated in combination in the same layer in order to satisfy the characteristics required for light-sensitive material, or the same coupler may be added to two or more layers.

The coupler can be incorporated in a silver halide emulsion layer by known techniques, such as the method described in U.S. Pat. No. 2,322,027. For example, the coupler is dissolved in a high boiling organic solvent such as phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate and diethyl azelate), and trimesylic acid esters (e.g., tributyl trimesylate), or a low boiling organic solvent having a boiling point of 30° C. to 150° C. such as lower alkyl acetates (e.g., ethyl acetate and butyl acetate), ethyl propionate, sec-butyl alcohols, methyl isobutyl ketone, $\beta$-ethoxyethyl acetate, and methyl cellosolve acetate and, thereafter, is dispersed in a hydrophilic colloid. The high boiling and low boiling organic solvents as described above may be used in combination with each other.

In addition, a dispersion method using the polymers described in Japanese Patent Publication No. 39853/76 and Japanese Patent Application (OPI) No. 59943/76 (the term "OPI" as used herein refers to a "published unexamined Japanese patent application") can be employed.

In the case of couplers containing an acid group, such as carboxylic acid and sulfonic acid, they are introduced in hydrophilic colloid as an alkaline aqueous solution.

Photographic color couplers are chosen so as to provide an intermediate scale image. It is preferred that the maximum absorption band of cyan dye formed from a cyan color former be between about 600 and 720 nm; the maximum absorption band of magenta dye formed from a magenta color former be between about 500 and 580 nm; and the maximum absorption band of yellow dye formed from a yellow color former be between about 400 and 480 nm.

The amount of the coupler represented by the formula (II) of the invention being added is from $2\times10^{-3}$ to $5\times10^{-1}$ mol, preferably from $1\times10^{-2}$ to $5\times10^{-1}$ mol, per mol of silver.

The amount of the color image stabilizer represented by the formula (I) of the invention being added is from 10 to 200 mol%, preferably from 30 to 100 mol%, based on the coupler represented by the formula (II) of the invention.

The light-sensitive material of the invention may contain, as anti-foggants, hydroquinone derivatives, aminophenol derivatives, gallic acid derivatives, ascorbic acid derivatives, and the like. Typical examples are described in, for example, U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75, 146235/77 and Japanese Patent Publication No. 23813/75.

The hydrophilic colloid layers of the light-sensitive material prepared according to the present invention can contain water-soluble dyes, as filter dyes, for purposes of preventing certain irradiations or other purposes. Such dyes include oxonol dyes, hemioxonol dyes, styryl dyes, merocyanine dyes, cyanine dyes and azo dyes. Of these dyes, oxonol dyes, hemioxonol dyes and merocyanine dyes are especially useful. Specific examples of such dyes which can be employed are described, for example, in British Pat. Nos. 584,609 and 1,177,429, Japanese Patent Application (OPI) Nos. 85130/73, 99620/74, 114420/74 and 108115/77, and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

The light-sensitive material of the invention may contain ultraviolet absorbers in the hydrophilic colloid layer thereof. Ultraviolet absorbers which can be used include aryl group-substituted benzotriazole compounds (e.g., the compounds described in U.S. Pat. No. 3,533,794), 4-thiazolidone compounds (e.g., the compounds described in U.S. Pat. Nos. 3,314,794 and 3,352,681), benzophenone compounds (e.g., the compounds described in Japanese Patent Application (OPI) No. 2784/71), cinnamates (e.g., the compounds described in U.S. Pat. Nos. 3,705,805 and 3,707,375), butadiene compounds (e.g., the compounds described in U.S. Pat. Nos. 4,045,229), and benzooxidol compounds (e.g., the compounds described in U.S. Pat. Nos. 3,700,455). In addition, the compounds described in U.S. Pat. No. 3,499,762 and Japanese Patent Application (OPI) No. 48535/79 can be used. Ultraviolet ray-absorbing couplers (e.g., α-naphthol-based cyan dye-forming couplers) and ultraviolet ray-absorbing polymers may be used. These ultraviolet ray-absorbers may be mordanted in a specific layer.

Photographic emulsions as used herein may be spectrally sensitized with dyes such as methine dyes. Dyes which can be used for this spectral sensitization include cyanine dye, merocyanine dye, complex cyanine dye, complex merocyanine dye, holopolar cyanine dye, hemicyanine dye, styryl dye, and hemioxonol dye. Especially useful dyes are cyanine dye, merocyanine dye and complex merocyanine dye. To these dyes can be applied any of nuclei commonly utilized in cyanine dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, and the like; nuclei resulting from the fusion of alicyclic hydrocarbon rings to the foregoing nuclei; and nuclei resulting from the fusion of aromatic hydrocarbon rings to the foregoing nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, and the like can be applied. These nuclei may be substituted at a carbon atom.

To merocyanine dye or complex merocyanine dye, 5- or 6-membered heterocyclic nuclei such as a pyrazolin-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus can be applied as nuclei having the ketomethylene structure.

Useful sensitizing dyes include the compounds as described in, for example, German Patent No. 929,080, U.S. Pat. Nos. 2,231,658, 2,493,748, 2,503,776, 2,519,001, 2,912,329, 3,656,959, 3,672,897, 3,694,217, 4,025,349, 4,046,572, British Pat. No. 1,242,588, Japanese Patent Publication Nos. 14030/69 and 24844/77.

These sensitizing dyes may be used singly or in combination with each other. Such combinations of sensitizing dyes are often used particularly for the purpose of supersensitization. Typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, Japanese Patent Application (OPI) Nos. 110618/77 and 109925/77.

Dyes not having a spectral sensitizing action by themselves, or substances not materially absorbing visible light but showing supersensitization may be incorporated into emulsions in combination with sensitizing dyes. For Example, nitrogen-containing heterocyclic group-substituted aminostyryl compounds (as described in, for example, U.S. Pat. Nos. 2,933,390 and 3,635,721), aromatic organic acid-formaldehyde condensates (as described in, for example, U.S. Pat. No. 3,743,510), cadmium salts, and azaindene compounds may be incorporated. Especially useful are the combinations described in U.S. Pat. Nos. 3,615,613, 3,615,641, 3,617,295 and 3,635,721.

The light-sensitive material of the invention can be processed by known techniques. In this photographic processing, the known processing solutions can be used. The processing temperature is usually chosen within the range of from 18° to 50° C. although lower temperatures than 18° C. or higher temperatures than 50° C. may be used. A developing processing (black-and-white photographic processing) to form a silver image, or a color photographic processing comprising a developing processing to form a dye image can be applied depending on the purpose.

In general, a color developer is composed of an alkaline aqueous solution containing a color developing agent. As such color developing agents, the known primary aromatic amine developing agents, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline) can be used.

In addition, the compounds as described in, for example, L. F. A. Mason, Photographic Processing Chemistry, Focal Press Ltd. (1966), pp. 226–229, U.S. Pat. Nos. 2,193,015, 2,592,364 and Japanese Patent Application (OPI) No. 64933/73 can be used.

The color developer can further contain pH buffers, such as sulfurous acid salts, carbonic acid salts, boric acid salts, and phosphoric acid salts of alkali metals; development inhibitors, such as bromides, iodides, and organic anti-foggants; and anti-foggants. If desired, hard water-softening agents; preservatives, such as hydroxylamine; organic solvents, such as benzyl alcohol and diethylene glycol; development accelerators, such as polyethylene glycol, quaternary ammonium salts, and amines; dye-forming couplers; competitive couplers; foggants, such as sodium boron hydride; auxiliary developing agents, such as 1-phenyl-3-pyrazolidone; tackifiers; polycarboxylic acid-based chelating agents as described in U.S. Pat. No. 4,083,723; antioxidants as described in West German Patent Application (OLS) No. 2,622,950, and the like can be added.

After color development, the photographic emulsion layer is usually bleached. This bleaching may be performed simultaneously with, or separately from, fixing. Bleaching agents which can be used include compounds of multivalent metals, such as iron (III), cobalt (III), chromium (VI), and copper (II), peracids, guinones, and nitroso compounds. Typical examples are ferricyanides; dichromic acid salts; organic complex salts of iron (III) or cobalt (III), for example, complex salts of organic acids, such as aminopoly-carboxylic acids (e.g., ethylenediaminetetraacetic acid and 1,3-diamino-2-propanoltetraacetic acid), citric acid, tartaric acid, or malic acid; persulfuric acid salts; permanganic acid salts; and nitrosophenol. Of these compounds, potassium ferricyanide, sodium iron (III) ethylenediaminetetraacetate, and ammonium iron (III) ethylenediaminetetraacetate are particularly useful. An ethylenediaminetetraacetic acid iron (III) complex salt is useful in both an independent bleaching solution and a combined bleaching and fixing solution.

To the bleaching or bleach-fixing solution, as well as the bleach accelerators described in, for example, U.S. Pat. Nos. 3,042,520, 3,241,966, Japanese Patent Publication Nos. 8506/70 and 8836/70, and the thiol compounds described in Japanese Patent Application (OPI) No. 65732/78, various additives can be added.

The present invention is described in greater detail with reference to the following examples.

EXAMPLE 1

Magenta coupler, C-2, of the present invention (8 g) was dissolved in 16 ml of tricresyl phosphate and 16 ml of ethyl acetate. The resulting solution was then emulsified in 80 g of a gelatin solution containing 8 ml of a 1% aqueous solution of sodium dodecylbenzenesulfonate.

The thus-prepared emulsion was mixed with 145 g of a green-sensitive silver chlorobromide emulsion (Br: 50 mol%; Ag: 7 g), and sodium dodecylbenzene-sulfonate was added thereto as an auxiliary coating agent. The resulting mixture was then coated on a paper support laminated with polyethylene on both surfaces thereof.

The amount of the coupler being coated was set at 325 mg/m$^2$. A gelatin protective layer (gelatin: 1 g/m$^2$) was coated on the layer as prepared above to form a light-sensitive material, Sample A.

Light-sensitive materials, Samples B to F, were prepared in the same manner as in the preparation of Sample A except that in preparing the emulsion as described above the color image stabilizers of the invention as shown in Table 1 were each added in an amount of 50 mol% of the coupler.

For comparison, a comparative light-sensitive material, Sample G, was prepared in the same manner as in the preparation of Sample A except that 6.4 g of Magenta Coupler C-25 of the present invention was dissolved in 15 ml of tricresyl phosphate and 15 ml of ethyl acetate, and the amount of the silver chlorobromide emulsion being used was twice that in the preparation of Sample A.

Light-sensitive materials, Samples H and I, were prepared in the same manner as in the preparation of Sample G except that the color image stabilizers of the present invention as shown in Table 1 were each added in an amount of 50 mol% of the coupler.

In addition, a comparative light-sensitive material, Sample J, was prepared in the same manner as in the preparation of Sample A except that Magenta Coupler, C-23, of the present invention was used in the same molar amount as in Sample A. Light-sensitive materials, Samples K and L, were prepared in the same manner as in the preparation of Sample J except that the color image stabilizers of the present invention as shown in Table 1 were each added.

Furthermore, a comparative light-sensitive material, Sample A', was prepared in the same manner as in the preparation of Sample A except that the following Comparison Coupler was used in place of Magenta Coupler C-2.

Comparison Coupler:

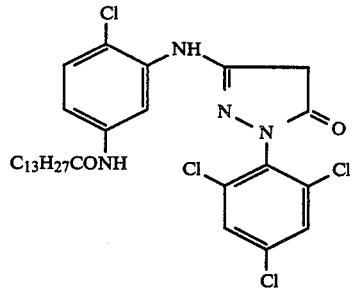

Also, a comparative light-sensitive material, Sample B', was prepared in the same manner as in the preparation of Sample B except that the above Comparison Coupler was used in place of Magenta Coupler C-2.

Each light-sensitive material was exposed to light and then treated with the following solutions:

| | |
|---|---|
| Developer: | |
| Benzyl alcohol | 15 ml |
| Diethylenetriaminepentaacetic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N—ethyl-N—β-(methanesulfonamido)ethylaniline.3/2 $H_2SO_4.H_2O$ | 4.5 g |
| Water to make | 1,000 ml (pH: 10.1) |
| Bleach-Fixing Solution: | |
| Ammonium thiosulfate (70% by weight) | 150 ml |
| $Na_2SO_3$ | 5 g |
| Na[Fe(EDTA)] | 40 g |
| EDTA | 4 g |
| Water to make | 1,000 ml (pH: 6.8) |

| Processing Steps: | Temperature (°C.) | Time (seconds) |
|---|---|---|
| Developing | 33 | 210 |
| Bleach-Fixing | 33 | 90 |
| Water-Rinsing | 28–35 | 180 |

Each sample with a dye image formed thereon as described above was subjected to a four-week fading testing using a fluorescent lamp fading tester (illumination: 15,000 lux) provided with an ultraviolet ray-absorbing filter (made by Fuji Photo Film Co., Ltd.) adapted to cut wavelengths of less than 400 nm. Changes in density at areas having initial densities of 2.0 and 1.0 were measured by the use of a Macbeth densitometer Model RD-514 (status AA filter).

The results are shown in Table 1. It can be seen that the color image stabilizers of the present invention are effective in preventing color fading of magenta color images formed from 1H-pyrazolo[3,2-C]-s-triazole. Further, it can also be understood from the results in Table 1 (especially, results of Samples A and B and Samples A' and B') that the color image stabilizers of the present invention are remarkably effective in preventing color fading of the magenta color images fromed from 1H-pyrazolo[3,2-C]-s-triazole magenta couplers of the present invention as compared with that of the magenta color images formed from the Comparison Coupler.

TABLE 1

| Sample | Coupler | Color Image Stabilizer | Change in Magenta Density (initial density: 2.0) | Change in Magenta Density (initial density: 1.0) | Remarks |
|---|---|---|---|---|---|
| A | C-2 | — | −1.49 | −0.82 | Comparison |
| B | " | A-1 | −0.32 | −0.25 | Invention |
| C | " | A-7 | −0.35 | −0.21 | " |
| D | " | A-14 | −0.36 | −0.22 | " |
| E | " | A-16 | −0.28 | −0.20 | " |
| F | " | A-17 | −0.29 | −0.22 | " |
| G | C-25 | — | −1.35 | −0.65 | Comparison |
| H | " | A-1 | −0.27 | −0.20 | Invention |
| I | " | A-15 | −0.25 | −0.18 | " |
| J | C-23 | — | −1.42 | −0.70 | Comparison |
| K | " | A-7 | −0.30 | −0.21 | Invention |
| L | " | A-15 | −0.27 | −0.19 | " |
| A' | Comparison Coupler | — | −0.98 | −0.54 | Comparison |
| B' | Comparison Coupler | A-1 | −0.40 | −0.28 | " |

EXAMPLE 2

Using the same magenta coupler as used in Example 1, Magenta Coupler C-2, a coating composition for use in the formation of the third layer, having the formulation as shown in Table 3 was prepared in the same manner as in the preparation of Sample A of Example 1. A multilayer light-sensitive material, Sample M, having the layer structure as shown in Table 3 was formed using the coating composition as prepared above.

Multilayer light-sensitive materials, Samples N to Q, were prepared in the same manner as in the preparation of Sample M except that the color image stabilizers of the present invention as shown in Table 2 were each added to the third layer.

Each light-sensitive material was exposed to light and processed in the same manner as in Example 1, and then was subjected to a four-week fading testing using a fluorescent lamp fading tester (illumination: 15,000 lux). The results are shown in Table 2.

It can be seen from Table 2 that the color image stabilizers of the present invention are effective in the stabilization of color images formed from 1H-pyrazolo[3,2-C]-s-triazole type couplers.

TABLE 2

| Sample | Color Image Stabilizer | Amount (mol %/ coupler) | Change in Magenta Density (initial density: 1.0) | Remarks |
|---|---|---|---|---|
| M | — | — | −0.54 | Comparison |
| N | A-7 | 30 | −0.18 | Invention |
| O | A-7 | 60 | −0.12 | " |
| P | A-16 | 30 | −0.16 | " |
| Q | A-17 | 30 | −0.17 | " |

TABLE 3

Sixth Layer (protective layer)
Gelatin (amount coated: 1,000 mg/m$^2$)
Fifth Layer
A silver chlorobromide emulsion (Br: 50 mol%; amount coated: 300 mg/m$^2$ (calculated as Ag));
A cyan coupler (*1) (amount coated: 400 mg/m$^2$);
A coupler solvent (*2) (amount coated: 200 mg/m$^2$); and
Gelatin (amount coated: 1,000 mg/m$^2$).
Fourth Layer
Gelatin (amount coated: 1,200 mg/m$^2$);
An ultraviolet ray-absorbing agent (*3) (amount coated: 1,000 mg/m$^2$); and
An ultraviolet ray-absorbing agent (*2) (amount coated: 250 mg/m$^2$).
Third Layer
A silver chlorobromide emulsion (Br: 50 mol%; amount coated: 200 mg/m$^2$ (calculated as Ag));
A magenta coupler (*4) (amount coated: 160 mg/m$^2$);
A coupler solvent (*5) (amount coated: 160 mg/m$^2$); and
Gelatin (amount coated: 1,000 mg/m$^2$).
Second Layer (intermediate layer)
Gelatin (amount coated: 1,000 mg/m$^2$)
First Layer
A silver chlorobromide emulsion (Br: 80 mol%; amount coated: 400 mg/m$^2$ (calculated as Ag));
A yellow coupler (*6) (amount coated: 300 mg/m$^2$);
A coupler solvent (*7) (amount coated: 150 mg/m$^2$); and
Gelatin (amount coated: 1,200 mg/m$^2$)
Support
Paper support laminated with polyethylene on both surfaces thereof.

Note:
*1 Coupler: 2-[α-(2,4-Di-tert-pentylphenoxy)butanamido]-4,6-dichloro-5-methylphenol
*2 Solvent: Dibutyl phthalate
*3 Ultraviolet ray-absorbing agent: 2-(2-Hydroxy-3-sec-butyl-5-tert-butylphenyl)benzotriazole
*4 Coupler: 3-[3-(3-Pentadecylphenoxy)propyl]-6-methyl-7-chloro-1H-pyrazolo[3,2-C]-s-triazole
*5 Solvent: Tricresyl phosphate
*6 Coupler: α-Pivaloyl-α-(2,4-dioxo-5,5'-dimethyloxazolidine-3-yl)-2-chloro-5-[α-(2,4-di-tert-pentylphenoxy)butanamido]acetanilide
*7 Solvent: Dioctylbutyl phosphate While the invention has been described in detail and with reference to specific embodiments thereof, it will be apparent to one skilled in the art that various changes and modifications can be made therein without departing from the spirit and scope thereof.

What is claimed is:

1. A color photographic silver halide light-sensitive material exhibiting improved light fastness, comprising:
a support base having thereon:
a silver halide emulsion layer;
a 1H-pyrazolo[3,3-C]-s-triazole coupler; and
a compound represented by the formula (I):

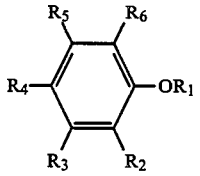

(I)

wherein $R_1$ is a hydrogen atom, an alkyl group, an aryl group, a silyl group, or a heterocyclic group; $R_2$, $R_3$, $R_5$ and $R_6$ are each a hydrogen atom, a hydroxyl group, an alkyl group, an aryl group, an alkoxyl group or an acylamino group; $R_4$ is an alkyl group, a hydroxyl group, an aryl group, a silyloxy group or an alkoxyl group; $R_1$ and $R_2$ may combine together to form a 5- or 5-membered ring, provided that $R_4$ is a hydroxyl group or an alkoxyl group, or $R_1$ and $R_2$ may combine together to form a methylenedioxy ring; and $R_3$ and $R_4$ may combine together to form a 5-membered hydrocarbon ring, provided that $R_1$ is an alkyl group, an aryl group, or a heterocyclic group.

2. A color photographic silver halide light-sensitive material as claimed in claim 1, wherein the coupler is represented by the formula (II):

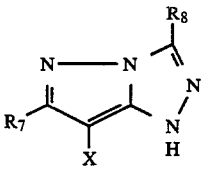

(II)

wherein $R_7$ and $R_8$ are each a hydrogen atom, an alkyl group, an alkylthio group, an aryl group, a heterocyclic ring consisting of from 5 to 6 atoms, an amino group, an acylamino group, a hydroxyl group, an alkoxyl group, an alkoxycarbonyl group, an aryloxycarbonyl group, a carbamoyl group, a sulfamoyl group or a sulfonamide group; and X is a hydrogen atom, a halogen atom, an alkoxyl group, an aryloxy group, an acyloxy group, a 5- or 6-membered heterocyclic oxy group, an alkylthio group, an arylthio group, a 5- or 6-membered heterocyclic ring thio group, or a group

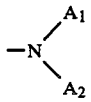

(wherein $A_1$ and $A_2$ are each a hydrogen atom, an alkyl group, an aryl group, a heterocyclic ring group, an acyl group, a sulfonyl group, a carbamoyl group, a sulfamoyl group, or an alkoxycarbonyl group, provided that $A_1$ and $A_2$ are not hydrogen atoms at the same time; and $A_1$ and $A_2$ may combine together to form a 5- or 6-membered ($6\pi$ or $10\pi$ electron system-constituting) aromatic heterocyclic group containing a nitrogen atom linked to a 5- or 6-membered ring formed in combination with a nitrogen atom, a nonaromatic saturated or unsaturated nitrogen-containing heterocyclic ring group, a cyclic imide group, a 2-N-1,1-dioxo-3-(2H)-oxo-1,2-benzisothiazolyl group (saccharin), or a saturated or unsaturated cyclic lactam ring group).

3. A color photographic silver halide light-sensitive material as claimed in claim 1, wherein the coupler is present in an amount in the range of $2\times10^{-3}$ to $5\times10^{-1}$ mol per mol of silver.

4. A color photographic silver halide light-sensitive material as claimed in claim 3, wherein the coupler is present in an amount in the range of $1\times10^{-2}$ to $5\times10^{-1}$ mol per mol of silver.

5. A color photographic silver halide light-sensitive material as claimed in claim 3, wherein the compound of formula (I) is present in an amount in the range of 10 to 200 mol% based on the amount of the coupler.

6. A coupler photographic silver halide light-sensitive material as claimed in claim 5, wherein the compound of formula (I) is present in an amount in the range of 30 to 100 mol% based on the amount of the coupler.

* * * * *

UNITED STATES PATENT AND TRADEMARK OFFICE

CERTIFICATE OF CORRECTION

PATENT NO. : 4,588,679

DATED : May 13, 1986

INVENTOR(S) : Nobuo Furutachi, Kanagawa, Japan

It is certified that error appears in the above-identified patent and that said Letters Patent is hereby corrected as shown below:

In column 21, line 17, of the patent, substitute for "a 5 or 5- membered ring", the phrase --a 5 or 6-membered ring--.

Signed and Sealed this

Eighth Day of September, 1987

*Attest:*

DONALD J. QUIGG

*Attesting Officer*

*Commissioner of Patents and Trademarks*